US006233744B1

(12) United States Patent
McDuff

(10) Patent No.: US 6,233,744 B1
(45) Date of Patent: May 22, 2001

(54) ASYMMETRICAL PROTECTIVE SPORTING GLOVES

(75) Inventor: Rodrigue McDuff, Laval (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/426,018

(22) Filed: Oct. 25, 1999

Related U.S. Application Data

(63) Continuation of application No. PCT/CA98/00158, filed on Feb. 25, 1998.

(51) Int. Cl.[7] ..... A41D 19/00

(52) U.S. Cl. ..... 2/161.1; 2/16; 2/20; 2/163

(58) Field of Search ..... 2/16, 20, 21, 159, 2/161.1, 161.6, 163, 167

(56) References Cited

U.S. PATENT DOCUMENTS

| | | | | |
|---|---|---|---|---|
| 3,725,957 | | 4/1973 | Shotmeyer . | |
| 4,027,339 | * | 6/1977 | Brucker | 2/16 |
| 4,137,572 | * | 2/1979 | Jansson et al. | 2/16 |
| 4,190,902 | | 3/1980 | Rhee . | |
| 4,497,073 | | 2/1985 | Deutsch . | |
| 4,677,698 | * | 7/1987 | Angas | 2/161 |
| 4,815,147 | | 3/1989 | Gazzano et al. . | |
| 4,930,162 | * | 6/1990 | Cote | 2/161 |
| 4,967,418 | * | 11/1990 | Marcotte | 2/16 |
| 5,237,703 | * | 8/1993 | Brine et al. | 2/16 |
| 5,488,739 | | 2/1996 | Cardinal . | |
| 5,511,243 | | 4/1996 | Hall et al. . | |
| 5,745,916 | * | 5/1998 | Linner | 2/16 |
| 5,787,506 | * | 8/1998 | Wilder et al. | 2/161.1 |
| 5,946,720 | * | 9/1999 | Sauriol | 2/16 |
| 5,983,396 | * | 11/1999 | Morrow et al. | 2/161.1 |

FOREIGN PATENT DOCUMENTS

| | | |
|---|---|---|
| 26 12 307 | 9/1977 | (DE) . |
| 2 148 0940 | 5/1985 | (GB) . |

* cited by examiner

*Primary Examiner*—John J. Calvert
*Assistant Examiner*—Katherine Moran
(74) *Attorney, Agent, or Firm*—Ratner & Prestia

(57) ABSTRACT

A pair of protective sporting gloves which includes a first glove and a second glove. The first glove has a preformed structure. The second glove has a different structure formed and angulated to define a shape adapted to the natural position taken by a hand holding the intermediate portion of a sport stick.

34 Claims, 7 Drawing Sheets

ASYMMETRICAL PROTECTIVE SPORTING GLOVES

This application is a continuation of PCT/CA98/00158, filed Feb. 25, 1998.

FIELD OF THE INVENTION

The invention relates to the field of protective equipment for use in sporting activities. More particularly, the invention relates to a pair of gloves with a first glove having a shape and profile adapted to the natural position taken by a hand holding the extremity of a stick, and a second glove having a different shape adapted to the natural position taken by the other hand holding the intermediate portion of a stick.

BACKGROUND OF THE INVENTION

For the past few years, protective equipment manufacturers have attempted to design hockey gloves that offer a lower resistance to the natural movement to which the hand is subject when handling a hockey stick.

U.S. Pat. No. 4,815,147 discloses a hockey glove which has a hand portion and a cuff portion joined together by a stretchable connecting portion. A protective strap-pad overlies the connecting portion to protect the player's wrist.

U.S. Pat. No. 5,511,243 discloses a hockey glove which has a cuff portion having a waist portion, such waist portion connects the cuff portion to a grip portion. A floating padded band covers the waist portion to protect the player's wrist.

While the gloves described in these patents may provide a certain amount of flexibility in the wrist area, they require a floating protective band to protect the flexible portion. By doing so, there are some areas near the edge of the hand portion and the cuff portion which are exposed to impact while the hand is bent.

U.S. Pat. No. 5,488,739 discloses a hockey glove which has a wrist protection section comprising an outer cuff portion structure and pads defining an inner band which is adjustable inside such outer cuff portion. Thus, the inner band may be adjustable in order that the glove is maintained around the wrist more or less firmly according to the player's wish.

While this glove may offer a certain amount of flexibility of the wrist when the player bends his hand downward, it still limits the freedom of movement of the hand when the player bends his hand back.

In prior art gloves, there is no distinction between a right hand and a left hand glove. The design of prior art gloves is thus not based on the differences that exist between the natural position taken by the hand holding the extremity of a hockey stick and the natural position of the other hand. However, these two positions are generally substantially different.

Therefore, there is a need in the industry to provide a pair of sporting gloves that is better adapted to the different positions of each hand holding a sport stick, for instance a hockey stick.

OBJECTS AND STATEMENT OF THE INVENTION

It is an object of the invention to provide a pair of sporting gloves that is better adapted to the natural position of each hand when holding a stick in a standard playing condition.

It is another object of the invention to provide a pair of sporting gloves with protective elements provided only where necessary.

It is another object of the invention to provide a pair of sporting gloves particularly adapted to a right shooter or a left shooter.

The invention seeks to provide a protective sport glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the proximal end portion of a sport stick in a generally standard playing position.

Such a glove provides enhanced comfort and ergonomics. These advantages bring some improvement in the player's performance. The glove also provides better control of the stick and so of the puck.

Preferably, the wrist receiving portion and the hand receiving portion are connected together, so that a substantially central and longitudinal axis (H—H), which projects from the metacarpus portion of the hand receiving portion and which is substantially parallel to the plane defined by said wrist receiving portion, and a substantially central and longitudinal axis (A—A) of the wrist receiving portion define at their intersection a given angle X, said angle being measured in a plane substantially corresponding to the plane defined by said wrist receiving portion. Advantageously, the angle is between 100 and 175 degrees and preferably between 120 and 160 degrees.

The glove is advantageously arranged so that the axis H—H substantially corresponds to the central and longitudinal axis H'—H' of the metacarpus portion of a wearer's hand and said axis A—A substantially corresponds to central and longitudinal axis A'—A' of said wearer's arm, said arm being adapted to wear said glove. The gloves are therefore designed accordingly and they correspond to the position adopted by the player during most of the playing time.

According to a variant of the protective glove, the wrist receiving portion and the hand receiving portion are connected together so that a substantially central and longitudinal axis H—H of the hand receiving portion and a substantially central and longitudinal axis A—A of the wrist receiving portion define at their intersection a given angle Y. Said angle is measured in a plane corresponding substantially to the plane defined by the pivoting movement of the hand on a wrist pivoting axis W—W of said glove.

The glove is also preferably provided with protective pad elements that protect the dorsal portion of said hand receiving portion and/or that protect the dorsal portion of said wrist receiving portion. The protective elements are thus provided where protection is really needed, and are suppressed from the areas where protection is less important, when considering the hand position. This results in weight efficient gloves.

Advantageously, the glove also comprises at least one flexion zone. This further improves comfort and ergonomics.

In another aspect, the invention also provides a protective sport glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the intermediate portion of a sport stick in a generally standard playing position.

For a right shooter, as illustrated in FIG. 1, the right hand corresponds to the distal hand, holding the intermediate portion of the stick, and the left hand corresponds to the proximal hand, holding the free end portion of the stick.

For a left shooter, the left hand corresponds to the distal hand, holding the intermediate portion of the stick, and the right hand corresponds to the proximal hand, holding the free end portion of the stick.

Preferably, the protective sport glove further comprises protective pad elements that protect the inner portion of said wrist receiving portion and/or a ventilation zone provided in the dorsal portion of said hand receiving portion. The protective elements are thus provided where protection is really needed, and can be suppressed from the areas where protection is less important when considering the hand position. This results in weight efficient gloves.

In a variant, the glove also comprises at least one flexion zone.

In another aspect, the invention also provides a pair of hockey gloves, for a hockey player, comprising a first glove for holding the extremity of a hockey stick, a second glove for holding the intermediate portion of said hockey stick, wherein said gloves are of different shape to better adapt to the different holding position with respect to the hockey stick.

In a further aspect, the invention also provides a pair of protective sport gloves, said pair comprising a first glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the proximal end portion of a sport stick in a generally standard playing position and a second glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the intermediate portion of a sport stick in a generally standard playing position.

The pair of gloves is thus customized so that a right shooter uses a specific pair of gloves and the left shooter wears a different pair of gloves, the proximal and distal hands being opposite.

The gloves according to the invention are advantageously suited for hockey, and in particular for forwards and defensemen.

According to the invention, the generally standard playing position corresponds to the position of a hockey player holding a hockey stick, with a first hand holding the free end portion of said stick and the second hand holding the intermediate portion of said stick. Such a position is illustrated in FIGS. 1 and 2.

In a variant, the specific shape of the glove is provided, in particular, in using a set of sheaths-formed and angulated to define said shape.

In another variant, the specific shape is provided, in particular, with the protective pad elements which are formed and angulated to define said shape.

In a further variant, the specific shape is provided, in particular, with inserts which are formed and angulated to define said shape.

In a further variant, the specific shape is provided, in particular, with specific portions of the sheaths that are stiffened so that the glove is formed and angulated to define said shape.

Other features of the invention will become apparent by reference to the following specification and to the drawings.

BRIEF DESCRIPTION OF THE DRAWINGS

A detailed description of the preferred embodiments of the invention is provided herein with reference to the following drawings, wherein.

Figure 2A:
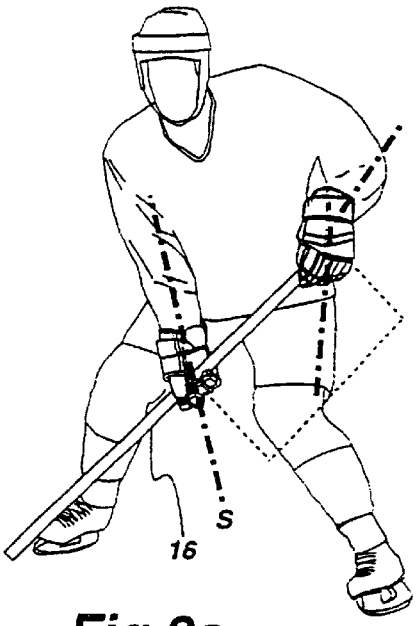
FIGS. 1, 2*a*, 2*b*, 3*a*, 3*b* and 3*c* are perspective views illustrating the natural position of the hands and forearms of a player holding a hockey stick.
Figure 2B:
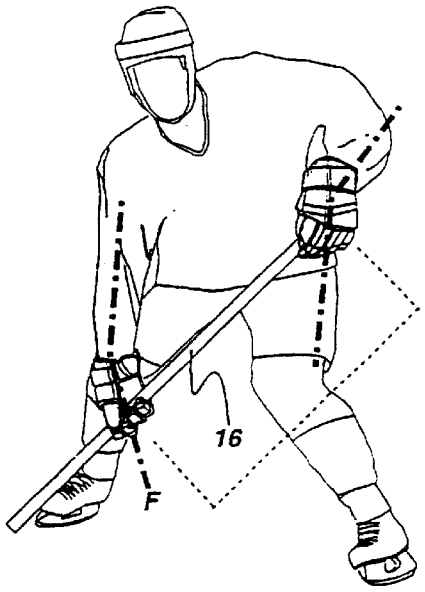

In the drawings, the preferred embodiment of the invention is illustrated by way of examples. It is to be expressly understood that the description and drawings are only for the purpose of illustration and are an aid for understanding. They are not intended as a definition of the limits of the invention.

DETAILED DESCRIPTION OF THE PREFERRED EMBODIMENT

FIGS. 1, 2*a*, 2*b*, 3*a*, 3*b* and 3*c* illustrate the natural position of hands 10R and 10L and forearms 12R and 12L of a right shooter holding a sport stick 16, wherein flexion of wrists 14R and 14L is required. The letters R and L designate the right and left hands respectively.

It is understood that the word "player" includes, but it is not confined to, ice hockey player, field hockey player, roller hockey player and lacrosse player, and the expression "sport stick" includes, but it is not confined to, ice hockey stick, field hockey stick, roller hockey stick and lacrosse stick. Such sport stick includes a shaft having a proximal end and a distal end, wherein a blade or a crosse is provided. Such sport stick may be made of wood, aluminum, composite, graphite or the like.

While playing hockey (or lacrosse), as the right hand 10R moves along the sport stick 16, the forearm 12R forms different angles with respect to the sport stick 16. Such angles vary depending on the position of the hand 10R on the stick 16: the nearer the hand 10R to the hand 10L, the more important the angle α between the hand 10R and the sport stick 16. The position of the hand 10R may thus vary between a first position, indicated with the letter F, and a second position, indicated with the letter S (see FIGS. 1, 2*a*, 2*b*, 3*a* and 3*b*).

Figure 3A:
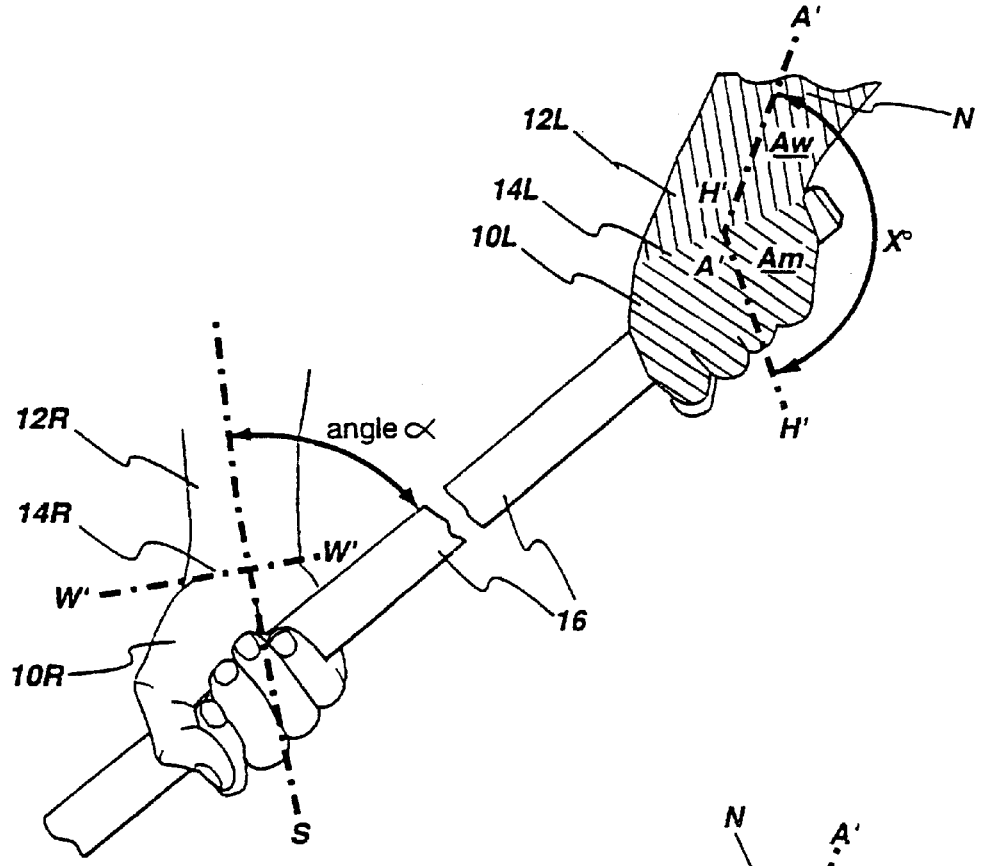
Figure 3B:
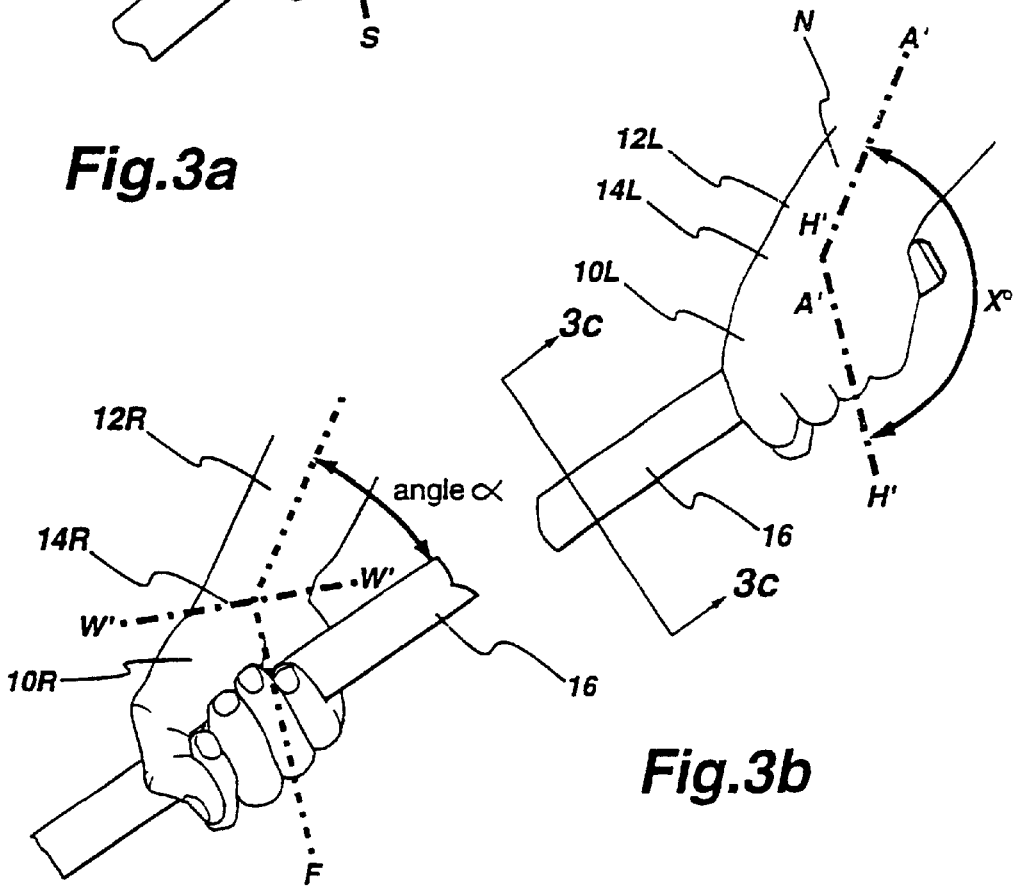
Figure 3C:
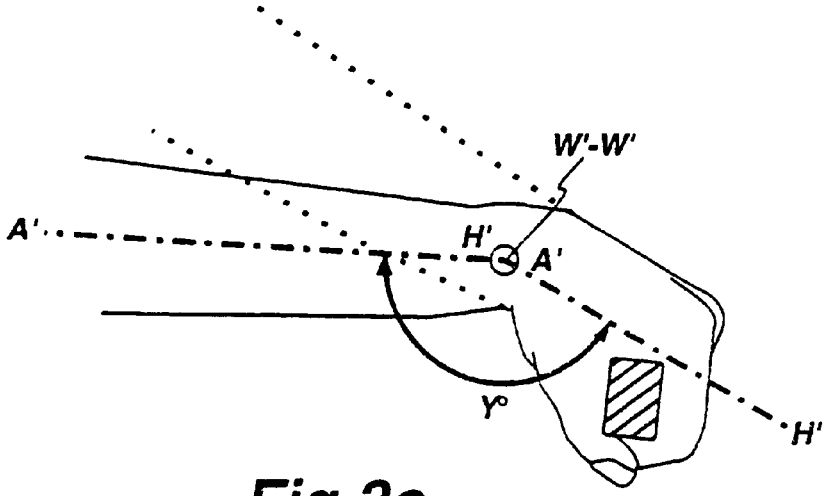

At the same time, the left hand 10L and the forearm 12L generally remain in the same position, wherein axis A'—A', defined by the longitudinal axis of the forehand, and axis H'—H', defined by the longitudinal axis of the hand namely the metacarpus portion of the hand, form an angle indicated with the letter X (FIG. 3*a*). Thus, the hand 10L and the wrist 14L define a natural position indicated with the letter N. Other angles may be formed between the hand and the arm or the fingers and the arm or hand, as described hereinafter. For example, the angle Y may be formed between the two planes adjacent to the wrist axis W'—W' (FIG. 3*c*).

Figure 4A:
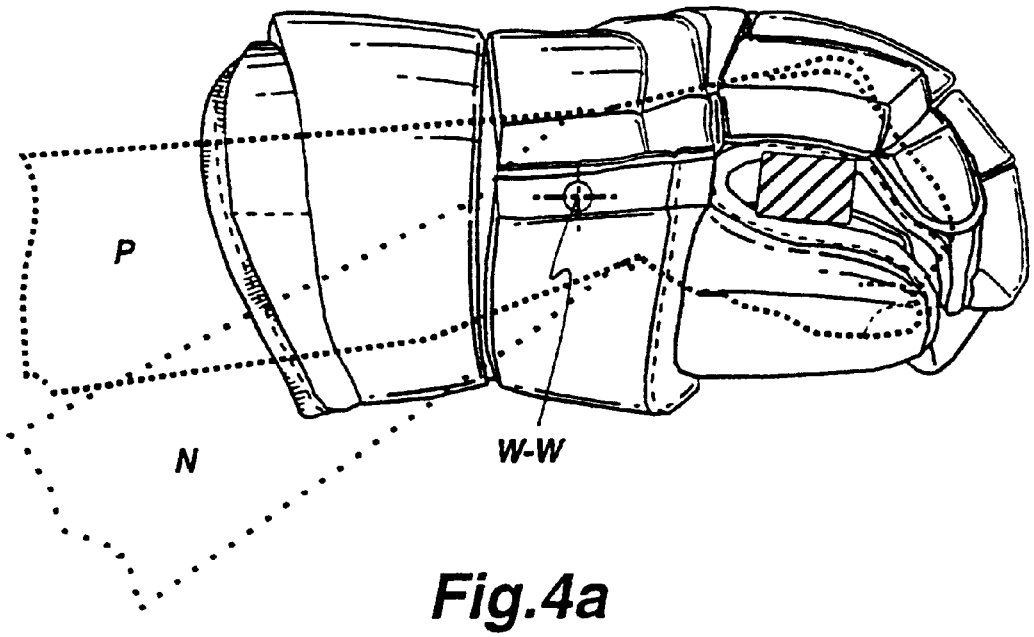
Fig.4a prior art
FIGS. 4*a* and 4*b* are perspective views of a left hand prior art glove worn by a right shooter wherein the natural position of the hand is shown in dotted line.
Figure 4B:
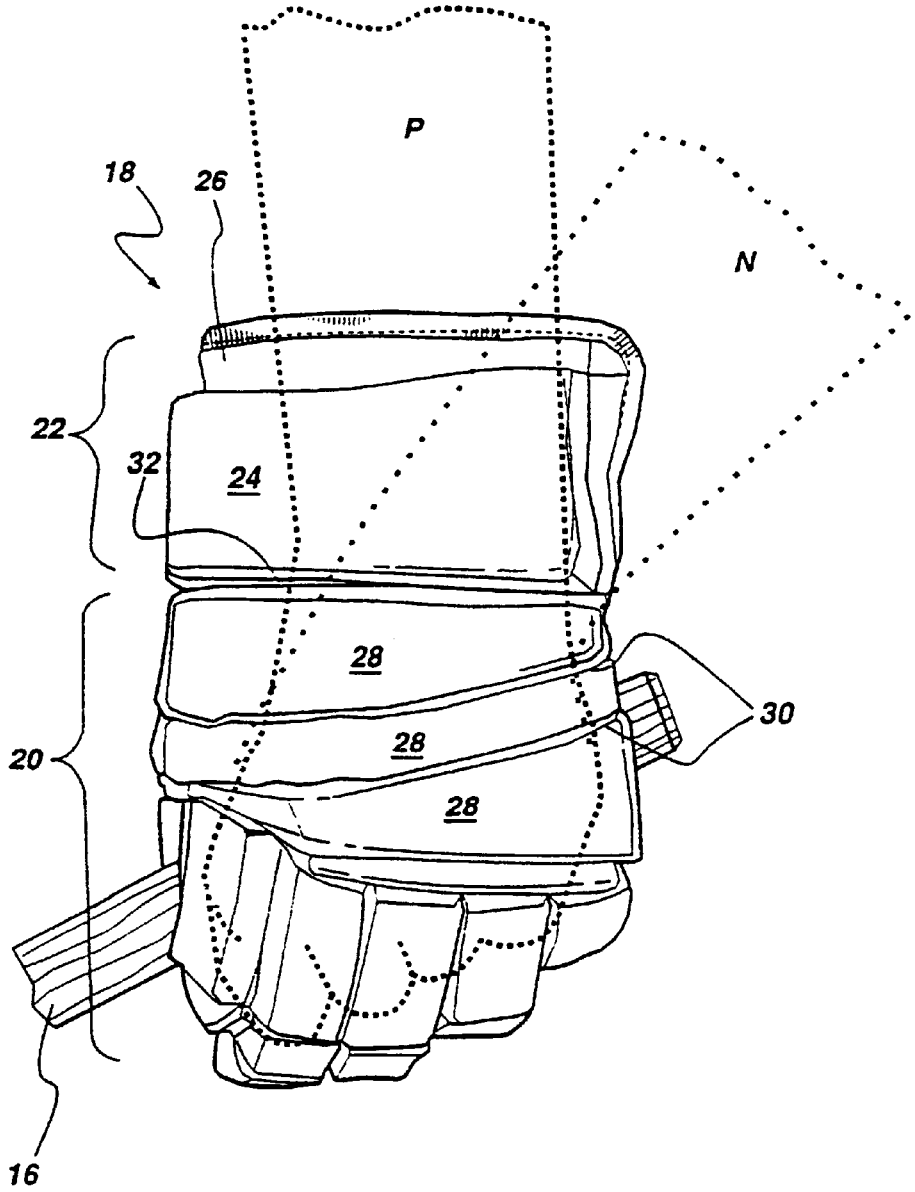
Fig.4b prior art

FIGS. 4*a* and 4*b* illustrate a prior art glove 18 worn by a right hand hockey player. The prior art glove usually comprises a hand receiving portion 20 and a wrist receiving portion 22. The wrist portion 22 comprises a protective pad 24 and a cuff portion 26. The hand portion 20 comprises a plurality of protective paddings 28 that protect the dorsal area of the metacarpus.

Even if the prior art glove 18 sometimes includes a flexion zone 30 located between two protective paddings 28 and flexion zone 32 located between the protective pad 24 and the protective padding 28 (or between the hand portion 20 and the cuff portion 26), the prior art glove 18 does not have a preformed shape adapted to the natural position taken by the wrist and the metacarpus of the hand holding the extremity of the sport stick 16. Indeed, as shown in FIGS. 4*a* and 4*b*, the prior art glove 18 forces the player's hand into the position indicated with the letter P, while the natural position of the player's hand is shown in a dotted line and indicated with the letter N. Therefore, the player who wears the prior art glove 18 has to provide a constant effort in order to maintain the prior art glove 18 in the natural position N, wherein the hand and the wrist define the angle X and/or Y.

Figure 5:
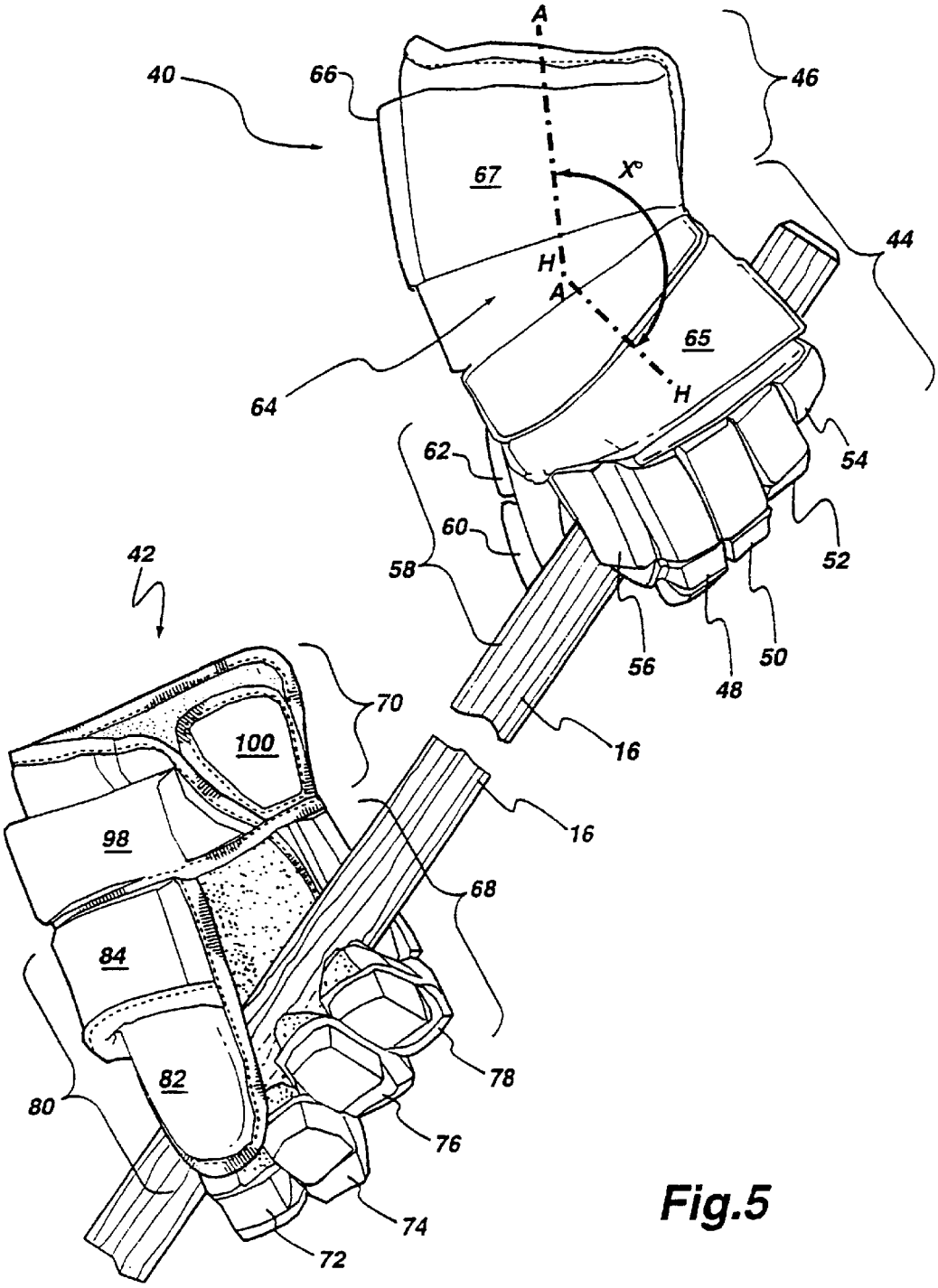
FIG. 5 is a perspective view of a pair of gloves designed in accordance with the invention for a right shooter.

FIG. 5 illustrates a pair of gloves constructed in accordance with the invention. The left hand glove that receives and encloses the hand holding the extremity of the sport stick 16 is designated by the reference number 40 and the right hand glove is designated by the reference number 42.

The left hand glove 40 comprises a hand receiving portion 44 and a wrist receiving portion 46. The hand receiving portion 44 comprises four finger sheaths 48, 50, 52 and 54 adapted to enclose the index finger, middle finger, third finger and little finger of the player, and a thumb sheath 58 adapted to enclose the thumb. The thumb sheath is preferably provided with protective pad elements 60 and 62. Advantageously, an elongated lateral protective element 56 adjacent to the index finger extends generally from the base of the index finger to approximately the beginning of the distal phalanx of the index finger.

The hand receiving portion 44 advantageously comprises a dorsal-metacarpus protective structure 65 to protect the dorsal area of the metacarpus, i.e. that part of the hand that connects the wrist to the fingers.

Figure 1:
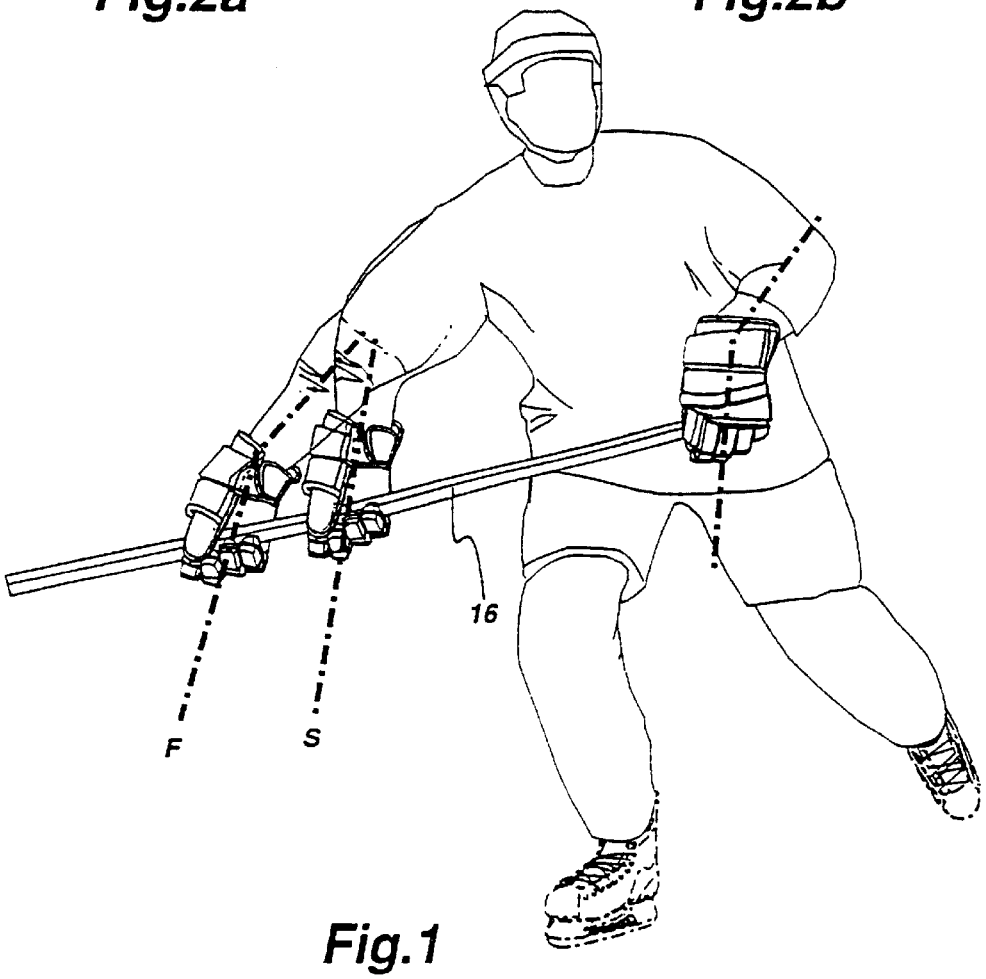

The glove of the invention may be manufactured in a traditional or non-traditional way to provide a shape, when the glove is at rest, substantially corresponding to the natural position N of the proximal hand, i.e. the hand that holds the extremity of a sport stick in normal play conditions, as illustrated in FIG. 1, for a right shooter.

For instance, the material or liner used to cover the hand and fingers may be cut and assembled so that its general shape corresponds to the above mentioned N position when at rest. Of course, the material is preferably flexible so that the player can modify the shape by exerting a given force with his fingers and/or hand. Appropriate protective padding is then provided, preferably with flexion zones, to protect the hand and forearm, while simultaneously, providing some flexibility to enable the player to temporarily move his hand and/or hold his stick in a different position.

Alternatively, the material or liner may be cut and assembled to get a traditional shape. The natural N shape is obtained in providing the material or liner with preformed elements, such as protective padding elements, forming elements, inserts, stiffened portions, or the like.

Advantageously, these elements are either substantially flexible or provided with flexion zones, to enable the player to temporarily modify the shape of the glove by exerting a given force with his fingers and/or his hand. Without such a force, or when at rest, the glove tends to recover the natural N shape.

The wrist portion 46 preferably comprises a dorsal-wrist protective structure 67, to protect the dorsal area of the wrist, and an inner wrist protective pad 66.

The dorsal-metacarpus protective structure 65 and the dorsal-wrist protective structure 67 could be integrally formed and angulated to define a protective structure 64 having a shape adapted to the natural position N taken by a hand holding the proximal end of the sport stick 16. Indeed, as indicated above and shown in FIGS. 3*a*, 3*b* and 3*c*, the hand holding the proximal end of the sport stick 16 adopts its natural position while the angle X and eventually Y are formed between the axis A—A and H—H. Preferably, when protective structure 64 is provided, its shape substantially corresponds to the natural position N.

Figure 6:
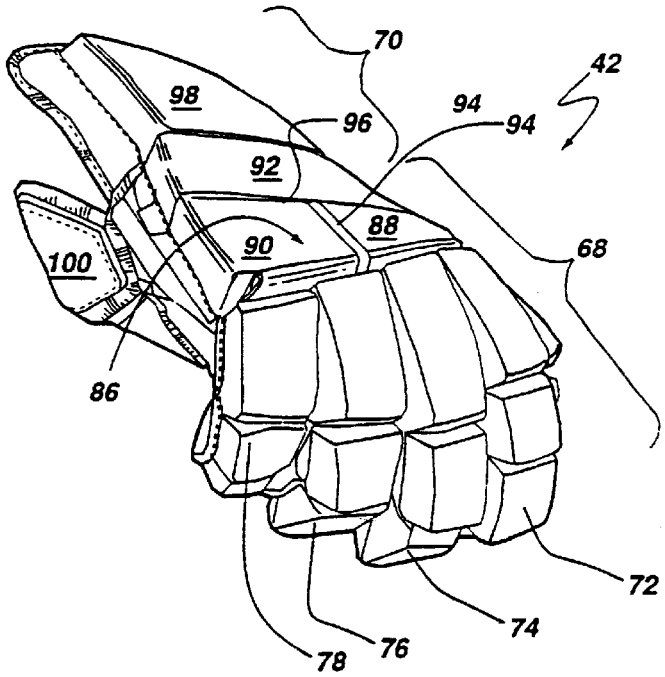
FIG. 6 is a perspective view of a right hand glove designed in accordance with the invention and for a right shooter.

Referring now to FIGS. 5 and 6, the right hand glove 42 comprises a hand receiving portion 68 and a wrist receiving portion 70. The hand receiving portion 68 comprises four finger sheaths 72, 74, 76 and 78 adapted to enclose the index finger, middle finger, third finger and little finger of the player, and a thumb sheath 80 adapted to enclose the thumb and having protective pad segments 82 and 84.

The hand receiving portion 68 may comprise a dorsal-metacarpus protective structure 86. The dorsal-metacarpus protective structure 86 comprises a plurality of protecting pad elements 88, 90, and 92 separated by flexion zones 94 and 96 that facilitate the natural movements of the right hand as illustrated in FIG. 1. Indeed, the flexion zones 94 and 96 allow flexion and lateral movements of the right hand. While the right hand glove 42 is described as having three protective pads 88, 90 and 92 and two flexion zones 94 and 96, it will be apparent to the person skilled in the art that a variety of other patterns of protective pads/flexion zones may be used.

The wrist portion 70 comprises a cuff protector 98 that surrounds the player's wrist. The cuff protector 98 may comprise an external protector 100, made of plastic, for instance, and sewn to the cuff protector 98. The external protector 100 offers an additional protection for the inner area of the wrist.

Thus, as described above and illustrated in FIGS. 5 and 6, the left hand glove 40 and the right hand glove 42 have different protective structures, each protective structure being adapted to accommodate the natural position of each hand when the player is holding the sport stick 16. For instance, the rear portion of the distal hand 42, generally less subject to hits, may comprise portions without protective pads or with a ventilation zone, to provide enhanced comfort and to minimize weight.

Figure 7:
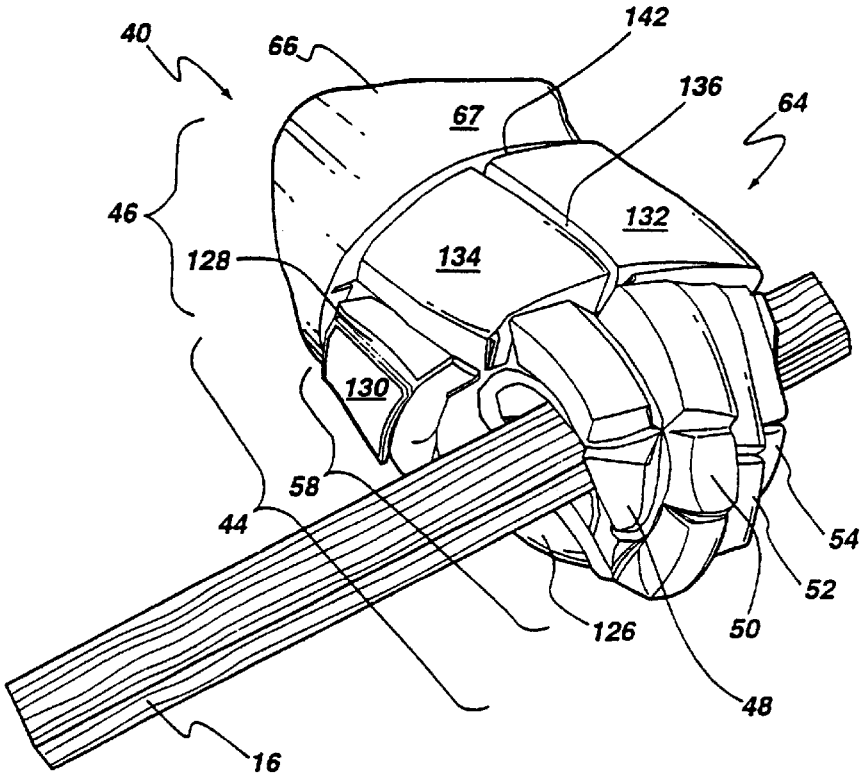
FIG. 7 is a perspective view of a left hand glove designed in accordance with a variant for a right shooter.
Figure 8:
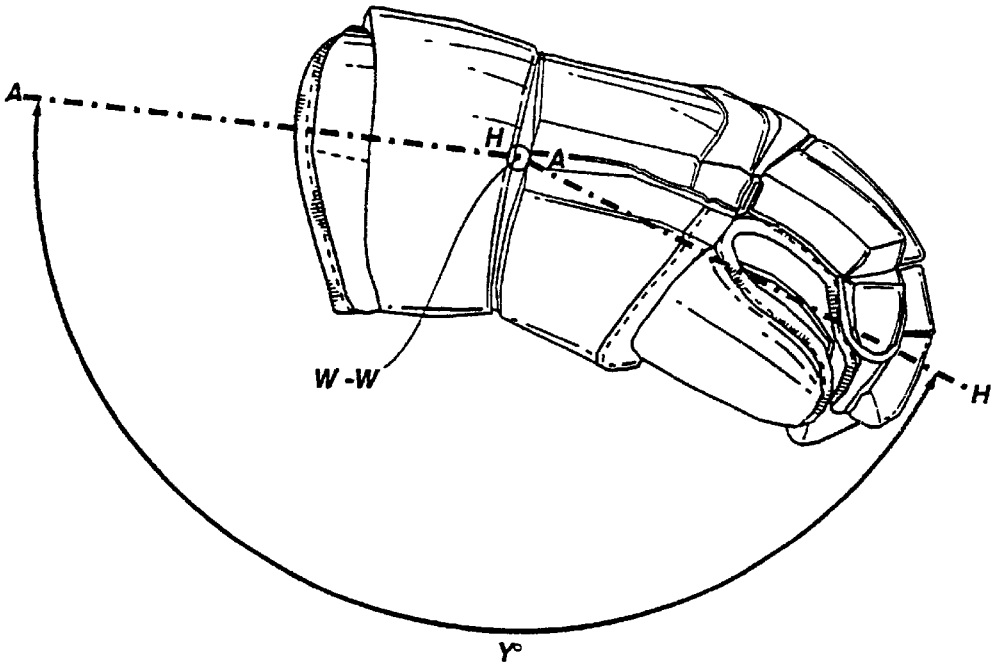
FIG. 8 is a perspective view of a right hand glove designed in accordance with the invention for a right shooter.

FIG. 7 illustrates a left hand glove 40 designed in accordance with a variant, wherein the glove is worn by a right shooter having his left hand holding the proximal extremity of the sport stick 16. Elements identical or similar to those previously described are presented with the same reference numbers.

The left hand glove 40 comprises a hand receiving portion 44 and a wrist receiving portion 46. The hand receiving portion 40 comprises four finger sheaths 48, 50, 52 and 54 adapted to enclose the index finger, middle finger, third finger and little finger of the player and a thumb sheath 58 adapted to enclose the thumb and having protective pad elements 126 and 128. The pad element 128 may comprise an external protector 130 made of plastic, for example, and sewn to the pad segment 128. Said external protector 130 offers an additional protection for the upper part of the thumb.

The hand receiving portion 44 and the wrist receiving portion 46 advantageously comprise protective pad elements 132 and 134 separated by a flexion zone 136. The protective pads 132 and 134 cover and protect the dorsal area of the part of the hand that connects the wrist to the fingers and the dorsal area of the wrist. The wrist receiving portion 46 also comprises a dorsal protective pad element 67, protecting the dorsal area of the wrist, and an inner wrist protective pad 66. The dorsal protective pad 67 is separated from the protective pads 132, 134 by a flexion zone 142.

The protective pads 132, 134 and 67 are formed and angulated to define a protective structure having a shape adapted to the natural position taken by a hand holding the proximal end of the sport stick 16, while a certain amount of flexibility is allowed. As indicated above and shown in FIG. 1, the hand holding the proximal end of the sport stick 16 adopts its natural position, wherein the angle X (and eventually Y) is formed between the hand and the wrist. Thus, the protective pads 132, 134 and 67 define a shape which substantially follows the angle X (and eventually Y), with the flexion zones 136 and 142 allowing some flexibility.

While the left hand glove 40 of FIG. 7 is described as having three protective pads 132, 134 and 67 and two flexion zones 136 and 142, it will be apparent to a person skilled in the art that a variety of other patterns of protective pads/flexion zones may be used to define a preformed flexible shape adapted to the natural position taken by the hand holding the proximal end of the sport stick 16.

The above description of the preferred embodiment should not be interpreted in any limiting manner since variations and refinements are possible which remain within the spirit and scope of the present invention. The scope of the invention is defined in the appended claims.

What is claimed is:

1. A protective sport glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers wherein said wrist receiving portion and said sheath portions are so arranged that they define a shape essentially corresponding to the natural position N taken by a player's hand and wrist when holding the proximal end portion of a sport stick in a generally standard playing position.

2. A protective sport glove according to claim 1, wherein said wrist receiving portion and said hand receiving portion are connected together so that a substantially central and longitudinal axis H—H, which projects from the metacarpus portion of said hand receiving portion and which is substantially parallel to the plane defined by said wrist receiving portion, and a substantially central and longitudinal axis A—A of said wrist receiving portion define at their intersection a given angle X, said angle being measured in a plane substantially corresponding to the plane defined by said wrist receiving portion.

3. A protective sport glove according to claim 2, further comprising a wrist portion having a pivoting axis W—W and wherein said wrist receiving portion and said hand receiving portion are connected together so that a substantially central and longitudinal axis H—H of said hand receiving portion and a substantially central and longitudinal axis A—A of said wrist receiving portion define at their intersection a given angle Y, said angle being measured in a plane substantially corresponding to the plane defined by the pivoting movement of the hand on the pivoting axis W—W of the wrist portion of said glove.

4. A protective sport glove according to claim 2, wherein said angle is between 100 and 175 degrees and preferably between 120 and 160 degrees.

5. A protective sport glove according to claim 3, wherein said axis W—W substantially corresponds to a wrist pivoting axis W'—W' of a wearer's hand.

6. A protective sport glove according to claim 4, further comprising protective pad elements and wherein said hand receiving portion has a dorsal portion, said protective pad elements protecting the dorsal portion of said hand receiving portion.

7. A protective sport glove according to claim 4, further comprising protective pad elements and wherein said wrist receiving portion has a dorsal portion, said protective pad elements protecting the dorsal portion of said wrist receiving portion.

8. A protective sport glove according to claim 4, further comprising at least one flexion zone.

9. A protecting sport glove according to claim 2, wherein said axis H—H corresponds to substantially central and longitudinal axis H'—H' of the metacarpus portion of a wearer's hand and said axis A—A corresponds to substantially central and longitudinal axis A'—A' of the wearer's arm, the arm being adapted to wear said glove.

10. A protective sport glove according to claim 9, further comprising protective pad elements and wherein said hand receiving portion has a dorsal portion, said protective pad elements protecting the dorsal portion of said hand receiving portion.

11. A protective sport glove according to claim 9, further comprising protective pad elements and wherein said wrist receiving portion has a dorsal portion, said protective pad elements protecting the dorsal portion of said wrist receiving portion.

12. A protective sport glove according to claim 9, further comprising at least one flexion zone.

13. A protective sport glove according to claim 3, further comprising protective pad elements and wherein said hand receiving portion has a dorsal portion, said protective pad elements protecting the dorsal portion of said hand receiving portion.

14. A protective sport glove according to claim 3, further comprising protective pad elements and wherein said wrist receiving portion has a dorsal portion, said protective pad elements protecting the dorsal portion of said wrist receiving portion.

15. A protective sport glove according to claim 3, further comprising at least one flexion zone.

16. A protective sport glove according to claim 1, wherein said protective sport glove is a hockey glove, said sport stick is a hockey stick, and said generally standard playing position corresponds to the position of a hockey player holding the hockey stick with a first hand holding the free end portion of the stick and the second hand holding the intermediate portion of the stick.

17. A protective sport glove comprising a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers wherein said wrist receiving portion and said sheath portions are so arranged that they define a shape essentially corresponding to the natural position N taken by a player's hand and wrist when holding the intermediate portion of a sport stick in a generally standard playing position.

18. A protective sport glove according to claim 17, further comprising protective pad elements and wherein said wrist receiving portion has an inner portion, said protective pad elements protecting the inner portion of said wrist receiving portion.

19. A protective sport glove according to claim 18, further comprising at least one flexion zone.

20. A protective sport glove according to claim 17, further comprising a ventilation zone and wherein said hand receiving portion has a dorsal portion, said ventilation zone provided in the dorsal portion of said hand receiving portion.

21. A pair of protective sport gloves, said pair including:

(a) a first glove having a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the proximal end portion of a sport stick in a generally standard playing position; and (b) a second glove having a hand receiving portion connected to a wrist receiving portion, said hand receiving portion having a plurality of finger sheath portions for receiving the fingers of a hand, a thumb sheath portion for receiving the thumb of a hand, a metacarpus sheath portion for receiving the part of the hand that connects the wrist to the fingers, wherein said sheath portions are so arranged that they define a shape substantially corresponding to the natural position N taken by a player's hand and wrist when holding the intermediate portion of a sport stick in a generally standard playing position.

22. A pair of protective sport gloves according to claim 21, wherein said sport is hockey and said generally standard playing position corresponds to the position of a hockey player holding a hockey stick with a first hand holding the free end portion of said stick and the second hand holding the intermediate portion of said stick.

23. A pair of protective sport gloves according to claim 22, wherein said wrist receiving portion and said hand receiving portion of said first glove are connected together so that a substantially central and longitudinal axis H—H, which projects from the metacarpus portion of said hand receiving portion and which is substantially parallel to the plane defined by said wrist receiving portion, and a substantially central and longitudinal axis A—A of said wrist receiving portion define at their intersection a given angle X, said angle being measured in a plane substantially corresponding to the plane defined by said wrist receiving portion.

24. A pair of protective sport gloves according to claim 23, wherein said angle is between 100 and 175 degrees and preferably between 120 and 160 degrees.

25. A pair of protective sport gloves according to claim 23, wherein said axis H—H corresponds to substantially central and longitudinal axis H'—H' of the metacarpus portion of a wearer's hand and said axis A—A corresponds to substantially central and longitudinal axis A'—A' of the wearer's arm, the arm being adapted to wear said glove.

26. A pair of protective sport gloves according to claim 23, wherein said wrist receiving portion, having a pivoting axis W—W, and said hand receiving portion of said first glove are connected together so that a substantially central and longitudinal axis H—H of said hand receiving portion and a substantially central and longitudinal axis A—A of said wrist receiving portion define at their intersection a given angle Y, said angle being measured in a plane substantially corresponding to the plane defined by the pivoting movement of the hand on the pivoting axis W—W of the wrist receiving portion of said glove.

27. A pair of protective sport gloves according to claim 26, wherein said axis W—W substantially corresponds to a wrist pivoting axis W'—W' of a wearer's hand.

28. A pair of protective sport gloves according to claim 23, wherein said set of sheaths is formed and angulated to define said shape.

29. A pair of protective sport gloves according to claim 23, wherein specific portions of the sheaths are stiffened so that the glove is formed and angulated to define said shape.

30. A pair of protective sport gloves according to claim 23, further comprising inserts formed and angulated to define said shape.

31. A pair of protective sport gloves according to claim 23, further comprising protective pad elements formed and angulated to define said shape.

32. A pair of protective sport gloves according to claim 21, wherein said second glove further comprising protective pad elements and wherein said wrist receiving portion has an inner portion, said protective pad elements protecting the inner portion of said wrist receiving portion.

33. A pair of protective sport gloves according to claim 21, wherein said second glove further comprising a ventilation zone and wherein said hand receiving portion has a dorsal portion, said ventilation zone provided in the dorsal portion of said hand receiving portion.

34. A pair of protective sport gloves according to claim 33, wherein said first and second gloves each comprise at least one flexion zone.

* * * * *